US008628168B2

(12) United States Patent
Igarashi

(10) Patent No.: US 8,628,168 B2
(45) Date of Patent: Jan. 14, 2014

(54) IMAGE FORMING APPARATUS AND IMAGE FORMING METHOD

(75) Inventor: Masanori Igarashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 374 days.

(21) Appl. No.: 13/170,333

(22) Filed: Jun. 28, 2011

(65) Prior Publication Data

US 2012/0007903 A1 Jan. 12, 2012

(30) Foreign Application Priority Data

Jul. 6, 2010 (JP) ..... 2010-153558

(51) Int. Cl.
*B41J 2/165* (2006.01)

(52) U.S. Cl.
USPC ..... 347/23; 347/24; 347/30

(58) Field of Classification Search
CPC ..... B41J 2/16532; B41J 2002/1657; B41J 2002/16573
USPC ..... 347/23, 24, 30
See application file for complete search history.

(56) References Cited

U.S. PATENT DOCUMENTS

| | | | | |
|---|---|---|---|---|
| 7,396,105 | B2 * | 7/2008 | Toki et al. | 347/35 |
| 7,547,089 | B2 * | 6/2009 | Uchida | 347/30 |
| 2002/0171706 | A1 * | 11/2002 | Miyamoto et al. | 347/30 |
| 2005/0099470 | A1 * | 5/2005 | Nishino | 347/84 |
| 2006/0023022 | A1 * | 2/2006 | Toki et al. | 347/36 |
| 2007/0252865 | A1 * | 11/2007 | Sakurai | 347/29 |
| 2008/0122891 | A1 * | 5/2008 | Nakano et al. | 347/23 |
| 2009/0309916 | A1 * | 12/2009 | Suzuki | 347/30 |

FOREIGN PATENT DOCUMENTS

| | | |
|---|---|---|
| JP | 5-138948 | 6/1993 |
| JP | 7-68795 | 3/1995 |
| JP | 9-141902 | 6/1997 |
| JP | 2001-191560 | 7/2001 |
| JP | 2006-16412 | 1/2006 |

* cited by examiner

*Primary Examiner* — Julian Huffman
(74) *Attorney, Agent, or Firm* — Cooper & Dunham LLP

(57) ABSTRACT

An image forming apparatus includes an ejection device, a suction device, and a controller. The ejection device has a first nozzle and a second nozzle to eject a first liquid and a second liquid, respectively. The first liquid contains pigment particles dispersed in a dispersion medium and the second liquid contains a color material. In a first image formation mode for ejecting the second liquid from the second nozzle without ejecting the first liquid from the first nozzle, the controller controls the suction device so as not to suction the first liquid for recovery operation. When the first image formation mode is switched to a second image formation mode for ejecting at least the first liquid from the first nozzle, the controller controls the suction device so as to suction a predetermined amount of the first liquid determined based on solidification of the first liquid to perform the recovery operation.

6 Claims, 10 Drawing Sheets

IMAGE FORMING APPARATUS AND IMAGE FORMING METHOD

CROSS-REFERENCE TO RELATED APPLICATIONS

The present patent application claims priority pursuant to 35 U.S.C. §119 from Japanese Patent Application No. 2010-153558, filed on Jul. 6, 2010 in the Japan Patent Office, which is hereby incorporated herein by reference in its entirety.

BACKGROUND

1. Technical Field

This disclosure relates to an apparatus and method for forming images, and more specifically, to an apparatus and method for forming images by ejecting liquid containing color materials.

2. Description of the Background Art

Image forming apparatuses are used as printers, facsimile machines, copiers, plotters, or multi-functional devices having two or more of the foregoing capabilities. As one type of image forming apparatuses are known inkjet-type image forming apparatuses (hereinafter, inkjet recording apparatus) having one or more recording heads for ejecting droplets of ink or other liquid.

With increasing demands for easily recording color images, such inkjet recording apparatuses have been widely used to form (record) color images on media for recording, such as sheets of paper (hereinafter, recording media) by ejecting ink droplets of different colors from the recording heads. A conventional type of inkjet recording apparatuses stop image recording when one of the different color inks runs out. However, there are demands from users for forming images using the other color inks even when one color is out of ink.

Hence, a conventional technique is proposed to output black-and-white images in only black ink when color inks (i.e., inks having colors other than black) run out and full-color output becomes unexecutable. In such a technique, the remaining amounts of basic constituent inks are detected to select one of full-color output and black-and-white output, thus allowing the black-and-white output to be executed even when color inks run out. Generally, after ejecting ink droplets from ejection ports of the recording heads, inkjet recording apparatuses may suction a predetermined amount of ink from the ejection ports to recover the ejection performance of the heads. However, a conventional inkjet recording apparatus simultaneously suctions the ejection ports for the respective color inks during recovery operation. Accordingly, for the above-described technique, ink is suctioned from nozzles from which ink droplets have not been ejected, thus wasting ink.

Hence, another technique is proposed for an inkjet recording apparatus that have a plurality of recording heads and a suction recovery unit and performs a sequence of operation in which suction recovery is performed on only a selected head(s). For this technique, when recording is performed using only a particular head(s) of the plurality of recording heads, the suction recovery is not performed on the other heads not used for the recording, thus preventing waste of ink.

Meanwhile, when the ejection ports of nozzles not used for recording are opened to ambient air, an increase in the viscosity of ink extends deep into the nozzles over time. In such a case, even if the suction recovery is performed on such nozzles to use the nozzles in the next recording, the increased viscosity of ink may not be completely removed. As a result, an ejection failure may occur, thus hampering accurate image formation.

BRIEF SUMMARY

In an aspect of this disclosure, there is provided an improved image forming apparatus including an ejection device, a suction device, and a controller. The ejection device has a first nozzle and a second nozzle to eject a first liquid and a second liquid, respectively. The first liquid contains pigment particles dispersed in a dispersion medium and the second liquid contains a color material. The suction device selectively suctions one of the first liquid from the first nozzle and the second liquid from the second nozzle to perform a recovery operation. The controller controls ejection of the first liquid and the second liquid by the ejection device and suctioning of the first liquid and the second liquid by the suction device. In a first image formation mode in which the ejection device forms an image on a recording medium by ejecting the second liquid from the second nozzle to the recording medium without ejecting the first liquid from the first nozzle, the controller controls the suction device so as not to suction the first liquid for the recovery operation. When the first image formation mode is switched to a second image formation mode in which the ejection device forms an image on a recording medium by ejecting at least the first liquid from the first nozzle to the recording medium, the controller controls the suction device so as to suction a predetermined amount of the first liquid determined based on solidification of the first liquid to perform the recovery operation.

In another aspect of this disclosure, there is provided an improved method of forming an image by an image forming apparatus. The apparatus includes an ejection device to eject a first liquid and a second liquid from a first nozzle and a second nozzle, respectively. The first liquid contains pigment particles dispersed in a dispersion medium and the second liquid contains a color material. The method includes controlling a suction device of the image forming apparatus so as not to suction the first liquid from the first nozzle for a recovery operation to recover an ejection performance of the ejection device in a first image formation mode to eject the second liquid from the second nozzle without ejecting the first liquid from the first nozzle to form an image on a recording medium, and controlling the suction device so as to suction a predetermined amount of the first liquid determined based on solidification of the first liquid for the recovery operation when the first image formation mode is switched to a second image formation mode to eject at least the first liquid from the first nozzle to form an image on a recording medium.

BRIEF DESCRIPTION OF THE DRAWINGS

The aforementioned and other aspects, features, and advantages will be better understood by reference to the following detailed description when considered in connection with the accompanying drawings, wherein.

Figure 1:
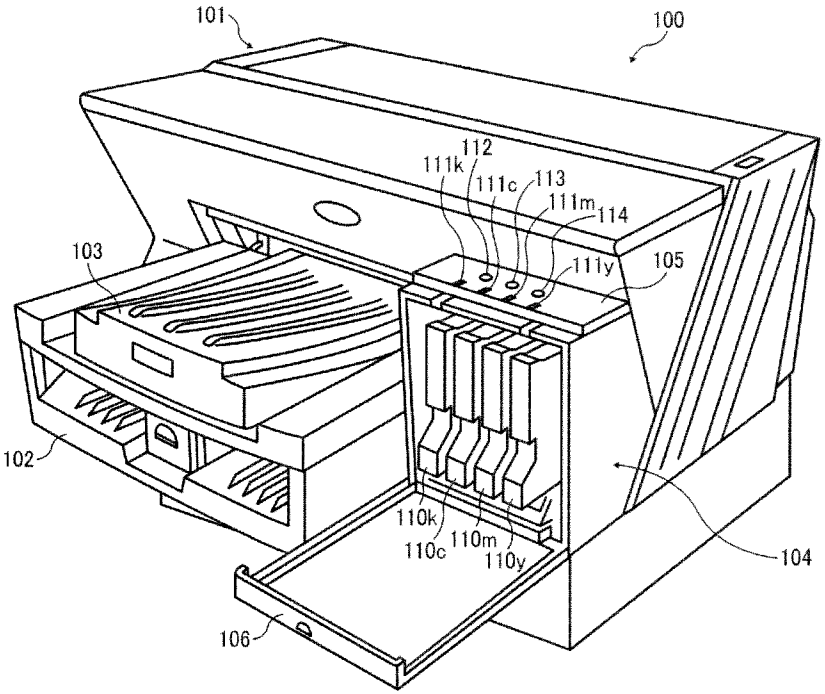
FIG. 1 is a schematic front view of an inkjet recording apparatus.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, an exemplary embodiment of the present disclosure is described below.

FIG. 1 is a front perspective view of an inkjet recording apparatus 100 according to an exemplary embodiment of this disclosure.

In FIG. 1, the inkjet recording apparatus 100 includes a housing 101, a sheet feed tray 102 mounted installed to the housing 101 to store sheets, and a sheet output tray 103 detachably mounted in the housing 101 to stack sheets on which images (including, e.g., characters and symbols) are formed (hereinafter, referred to as "recorded"). At one end portion of the front side of the housing 101 (i.e., a lateral side of a sheet tray section including the sheet feed tray 102 and the sheet output tray 103) is disposed a cartridge mount portion 104 that protrudes forward from the front face of the housing 101 and is positioned lower than the top face of the housing 101. On the top face of the cartridge mount portion 104 is mounted an operation-and-display unit 105 including operation buttons and indicators.

Ink cartridges 110K, 110C, 110M, and 110Y (hereinafter collectively referred to as "ink cartridges 110" unless colors are distinguished) are detachably inserted to the cartridge mount portion 104 from the front side toward the rear side of the housing 101. The ink cartridges 110K, 110C, 110M, and 110Y are recording-liquid containers to store recording liquids (hereinafter, referred to as "ink") containing a plurality of different color materials, e.g., black (K), cyan (C), magenta (M), and yellow (Y) inks. At the front side of the cartridge mount portion 104 is openably/closably mounted a front cover (cartridge cover) 106 that opens when the ink cartridges 110 are detached from the cartridge mount portion 104. In FIG. 1, the ink cartridges 110K, 110C, 110M, and 110Y are mounted standing side by side in the cartridge mount portion 104.

The operation-and-display unit 105 includes remaining-quantity indicators 111K, 111C, 111M, and 111Y indicating that the remaining quantities of the respective color inks in the ink cartridges 110K, 110C, 110M, and 110Y are at end state or near-end state. On operation-and-display unit 105, the remaining-quantity indicators 111K, 111C, 111M, and 111Y (hereinafter collectively referred to as "remaining-quantity indicators 111" unless colors are distinguished) are disposed at positions corresponding to the mount positions of the ink cartridges 110K, 110C, 110M, and 110Y. Further, a power button 112, a sheet-feed/record-restart button 113, and a cancel button 114 are disposed on the operation-and-display unit 105.

Figure 2:
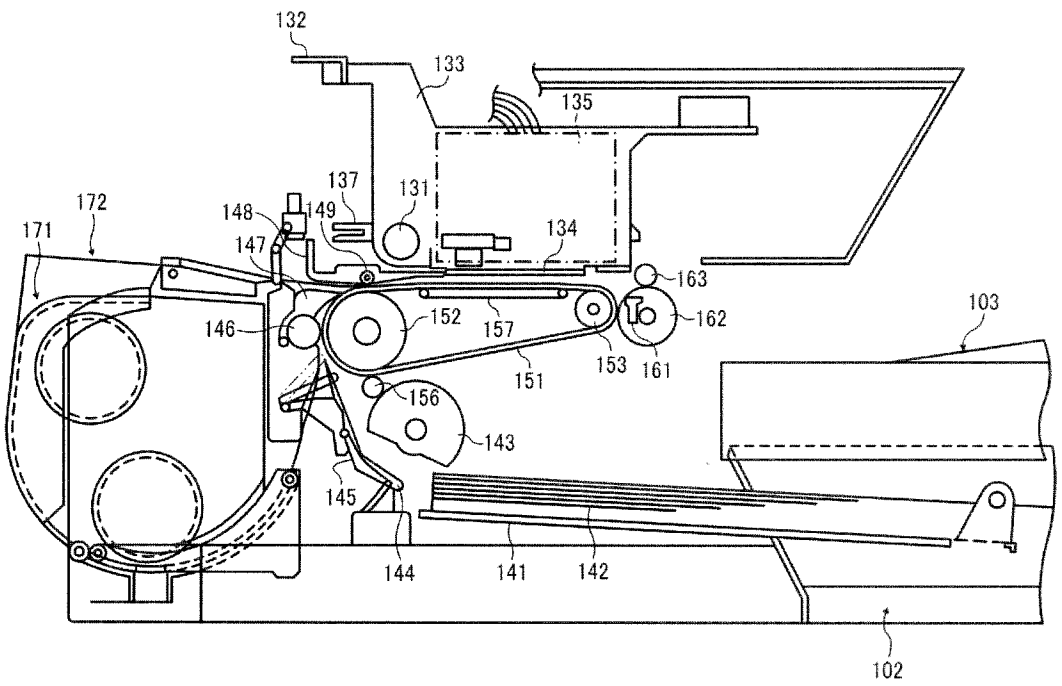
FIG. 2 is a schematic side view of a mechanical section of the inkjet recording apparatus illustrated in FIG. 1.
Figure 3:
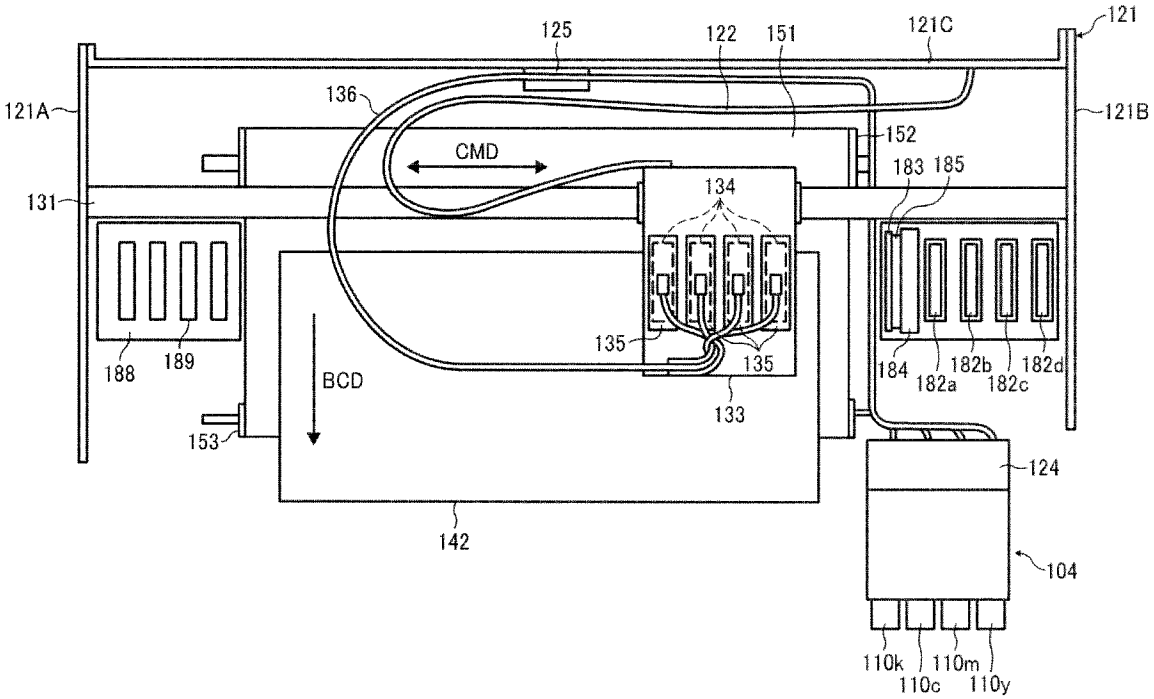
FIG. 3 is a plan view of the mechanical section of the inkjet recording apparatus illustrated in FIG. 2.

Next, an example of a mechanical section of the inkjet recording apparatus 100 is described with reference to FIGS. 2 and 3. FIG. 2 is a schematic side view illustrating the inkjet recording apparatus 100. FIG. 3 is a partial plan view illustrating the inkjet recording apparatus 100.

In the mechanical section of the inkjet recording apparatus 100, a carriage 133 is held with a guide rod 131 and a stay 132 so as to slide in a main scan direction MSD indicated by a double arrow illustrated in FIG. 3. The guide rod 131 and the stay 132 serving as guide members are extended between side plates 121A and 121B constituting a frame 121. The carriage 133 is moved by a main scan motor, not illustrated, for scanning in the main scan direction MSD.

On the carriage 133 are mounted recording heads 134 that are four droplet ejection heads to eject droplets of the different color inks of Y, C, M, and K. The recording heads 134 are mounted on the carriage 133 so that a plurality of ejection ports is arranged in a direction perpendicular to the main scan direction and ink droplets are ejected downward from the ejection ports.

As a pressure generator that generates pressure to eject droplets, the inkjet heads constituting the recording heads 134 may employ, for example, a piezoelectric actuator such as a piezoelectric element, a thermal actuator that generates film boiling of liquid (ink) using an electro/thermal converting element such as a heat-generation resistant to cause a phase change, a shape-memory-alloy actuator that changes metal phase by a temperature change, or an electrostatic actuator that generates pressure by electrostatic force.

The recording heads 134 are mounted with driver ICs (integrated circuits) connected to a controller via a harness (flexible print cable) 122. On the carriage 133 is mounted a plurality of head tanks 135 that supplies the different color inks to the recording heads 134. The different color inks are supplied (refilled) from the ink cartridges 110K, 110C, 110M, and 110Y mounted in the cartridge mount portion 104 to the head tanks 135 via ink supply tubes 136. In the cartridge mount portion 104 is mounted a supply-pump unit 124 that feeds ink from the ink cartridges 110. The ink supply tubes 136 are held with a stopper 125 on a rear plate 121C that forms a portion of the frame 121.

A sheet feed section that feeds sheets 142 stacked on a sheet stack portion (platen) 141 of the sheet feed tray 102. The sheet feed section further includes a sheet feed roller 143 that separates the sheets 142 from the sheet stack portion 141 and feeds the sheets 142 sheet by sheet and a separation pad 144 that is disposed facing the sheet feed roller 143. The separation pad 144 is made of a material of a high friction coefficient and biased (urged) toward the sheet feed roller 143. In other words, a momentum toward the sheet feed roller 143 is given to the separation pad 144.

To feed the sheets 142 from the sheet feed section to a position below the recording heads 134, the inkjet recording apparatus 100 includes a first guide member 145 that guides the sheet 142, a counter roller 146, a conveyance guide member 147, a press member 148 including a front-end press roller 149, and a conveyance belt 151 that conveys the sheet 142 to a position opposing the recording heads 134 with the sheet 142 electrostatically attracted thereon.

The conveyance belt 151 is an endless belt that is looped between a conveyance roller 152 and a tension roller 153 so as to circulate in a belt conveyance direction (sub-scan direction). A charge roller 156 is provided to charge the surface of the conveyance belt 151. The charge roller 156 is disposed so as to contact the surface of the conveyance belt 151 and rotate in accordance with the circulation of the conveyance belt 151 (i.e., rotate by receiving a force transmitted from the conveyance belt 151). On the back side of the conveyance belt 151 is disposed a second guide member 157 at a position corresponding to a print area of the recording heads 134.

The conveyance roller 152 is rotated by a sub-scan motor, not illustrated, via a timing roller, so that the conveyance belt 151 circulates in the belt conveyance direction "BCD" illustrated in FIG. 3.

The inkjet recording apparatus 100 further includes a sheet output section that outputs the sheet 142 on which an image has been formed by the recording heads 134. The sheet output section includes a separation claw 161 that separates the sheet 142 from the conveyance belt 151, a first output roller 162, a second output roller 163, and a sheet output tray 103 disposed below the first output roller 162.

A duplex unit 171 is detachably mounted on a rear portion of the housing 101. When the conveyance belt 151 rotates in the reverse direction to return the sheet 142, the duplex unit 171 receives the sheet 142. Then the duplex unit 171 turns the sheet 142 upside down to feed the sheet 142 between the counter roller 146 and the conveyance belt 151. At the top face of the duplex unit 171 is formed a manual-feed tray 172.

As illustrated in FIG. 3, a maintenance-and-recovery unit 181 is disposed at a non-recording area that is located on one end in the main-scan direction of the carriage 133. The maintenance-and-recovery unit 181 maintains and recovers nozzle conditions of the recording heads 134.

The maintenance-and-recovery unit 181 includes caps 182*a* to 182*d* (hereinafter collectively referred to as "caps 182" unless distinguished) that cover the nozzle faces of the recording heads 134, a wiper blade 183 that is a blade member to wipe the nozzle faces of the recording heads 134, and a first droplet receptacle 184 that receives ink droplets discharged to remove increased-viscosity ink during maintenance ejection. For example, the cap 182*a* may be used for ink suction and moisture retention while the other caps 182*b* to 182*d* for moisture retention.

Waste liquid (e.g., increased-viscosity ink) expelled in maintenance-and-recovery operation of the maintenance-and-recovery unit 181, ink discharged to the caps 182, ink adhered to the wiper blade 183, ink wiped with a wiper cleaner 185, and ink discharged to the first droplet receptacle 184 are kept in a waste tank, not illustrated.

As illustrated in FIG. 3, a second droplet receptacle 188 is disposed at a non-recording area on the other end in the main-scan direction of the carriage 133. The second droplet receptacle 188 receives ink droplets that are discharged to remove increased-viscosity ink in recording (image forming) operation and so forth. The second droplet receptacle 188 has openings 189 arranged in parallel with the rows of nozzles of the recording heads 134.

In the inkjet recording apparatus 100 having the above-described configuration, the sheet 142 is separated sheet by sheet from the sheet feed tray 102, fed in a substantially vertically upward direction, guided along the first guide member 145, and conveyed between the conveyance belt 151 and the counter roller 146. Further, the front tip of the sheet 142 is guided with a conveyance guide 137 and pressed against the conveyance belt 151 by the front-end press roller 149 to turn the traveling direction of the sheet 142 by substantially 90°.

At this time, an AC (alternating current) bias supply unit alternately supplies positive and negative voltages to the charge roller 156 so that the conveyance belt 151 is charged with an alternating voltage pattern, that is, an alternating band pattern of positively-charged areas and negatively-charged areas. When the sheet 142 is fed onto the conveyance belt 151 alternatively charged with positive and negative charges, the sheet 142 is attracted on the conveyance belt 151 and conveyed in the sub scanning direction by circulation of the conveyance belt 151.

By driving the recording heads 134 in response to image signals while moving the carriage 133 in the main scan direction in accordance with information on the position of the carriage 133 detected with a linear encoder 137, ink droplets are ejected onto the sheet 142, which is stopped below the recording heads 134, to form one band of a desired image. Then, the sheet 142 is fed by a certain distance to prepare for the next operation to record another band of the image. Receiving a signal indicating that the image has been recorded or the rear end of the sheet 142 has arrived at the recording area, the recording heads 134 finish the recording operation and the sheet 142 is outputted to the sheet output tray 103.

In waiting for the next recording (printing) operation, the carriage 133 moves to the maintenance-and-recovery unit 181 and the caps 182 cover the recording heads 134. Thus, the moisture of the nozzles is kept to prevent an ejection failure due to ink drying. Then, a suction pump suctions ink from the nozzles with the recording heads 134 covered with the caps 182, which is called "nozzle suction" or "head suction". Thus, the recovery operation is performed to remove increased-viscosity ink (recording liquid), solidified ink, and/or air bubbles. In such a case, one droplet ejection head of the recording heads 134 is moved above the cap 182*a*, and the caps 182 are raised to suction the head. Such a configuration allows selective suctioning of a desired color ink from nozzles of the droplet ejection head. Further, before or during a recording operation, the above-described maintenance ejection is performed to discharge ink for maintenance that is not used to form an image on the sheet. Such maintenance ejection allows keeping a stable ejection performance of the recording heads 134.

Next, an example of functional blocks of the inkjet recording apparatus 100 of this exemplary embodiment is described with reference to FIG. 4.

Figure 4:
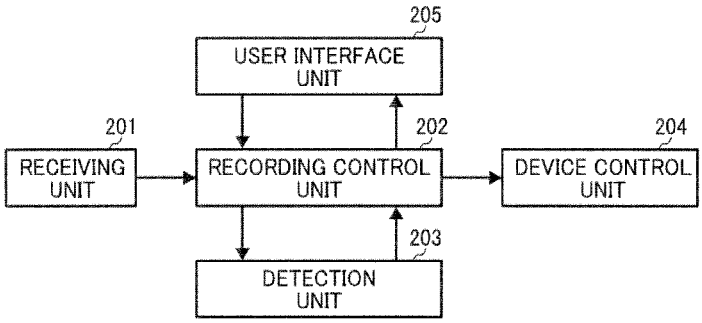
FIG. 4 is a block diagrams of functions of the inkjet recording apparatus.

FIG. 4 is a functional block diagram of the inkjet recording apparatus 100 according to the present exemplary embodiment. In this exemplary embodiment, the inkjet recording apparatus 100 includes, for example, a receiving unit 201, a recording control unit 202, a detection unit 203, a device control unit 204, and a user interface unit 205. These units are realized by operating in response to instructions from a central processing unit (CPU) in accordance with an image formation program stored in a read-only memory (ROM) of the inkjet recording apparatus 100.

The receiving unit 201 includes, for example, a network interface to receive image data from an external device, e.g., information processing device, via a network. The recording control unit 202 queries the remaining amount of ink to the detection unit 203 and determines an executable operation mode based on the remaining amount of ink detected by the detection unit 203. The recording control unit 202 requests to the device control unit 204 processing based on, e.g., recording, recovery operation, or cartridge replacement in accordance with the operation mode determined by the recording control unit 202. The device control unit 204 causes a relevant component/unit to perform processing based on recording, recovery operation, or cartridge replacement. For example, the device control unit 204 causes the recording heads 134 to eject ink or the maintenance-and-recovery unit 181 to suction ink. The user interface unit 205 receives operation modes selected by users of the inkjet recording apparatus 100. The user interface unit 205 also indicates the remaining amounts of inks on the remaining-amount indicators 111.

The detection unit 203 manages the remaining amount of ink in each of the ink cartridges 110 and the head tanks 135. For example, the remaining amount of ink in one of the head tanks 135 is obtained by subtracting a consumption amount of ink used in, e.g., image recording or recovery operation, from a total amount of ink at a state in which the head tank 135 is full of ink. Here, regarding the consumption amount of ink in recovery operation, for example, the consumption amount of ink in maintenance ejection is the same as that in image recording and the consumption amount of ink in suctioning is determined based on the rotation speed of a motor for driving the suction pump. The remaining amount of ink in each of the head tanks 135 may be displayed for management in units of percentage, e.g., in a range from 0% (ink empty) to 100% (ink full).

The remaining amount of ink in each of the ink cartridges 110 is determined by subtracting an amount of ink supplied to the corresponding head tank 135 (i.e., an increased amount of ink in the corresponding head tank 135) from an actual remaining amount of ink in the ink cartridge 110 at the time. The remaining amount of ink in each of the ink cartridges 110 may be displayed for management in units of percentage, e.g., in a range from 0% (ink empty) to 100% (ink full).

Next, inks used in the inkjet recording apparatus according to this exemplary embodiment are described below. Inks used in the inkjet recording apparatus according to this exemplary embodiment are, for example, liquids containing color materials, and at least one color ink can be solidified by drying. As the ink solidified by drying, for example, a pigment-dispersed liquid (hereinafter, pigment ink) in which pigment is dispersed in a dispersion medium may be used. To obtain a stable ejection performance, the pigment ink is prepared so that a solid component, such as a pigment, dispersed in the dispersion medium has an average particle diameter of, for example, 200 nm or lower. When the pigment ink contacts ambient air at ejection ports of the recording heads 134, the dispersion medium vaporizes, so that the solid component is condensed and aggregated.

Figure 5:
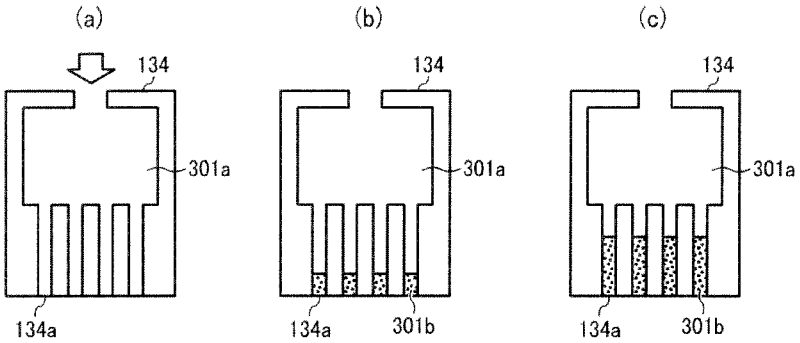
FIGS. 5*a* to 5*c* are schematic vertical cross-section views of a recording head to which dye ink is replenished.
Figure 6:
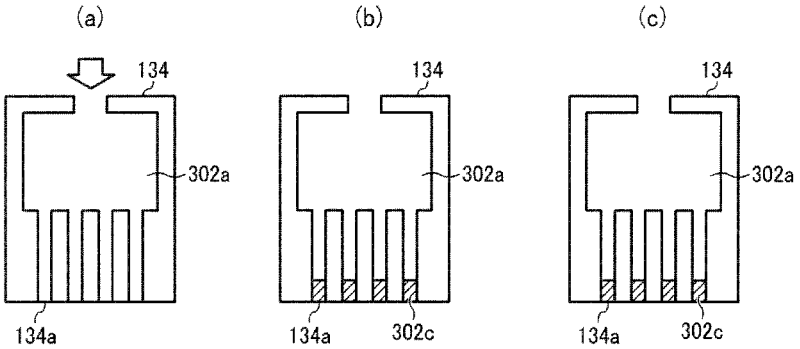
FIGS. 6*a* to 6*c* are schematic vertical cross-section views of a recording head to which pigment ink is replenished.

Next, drying of the pigment ink and liquid containing dyes (hereinafter, dye inks) in the recording heads 134 is described with reference to FIGS. 5 and 6. FIGS. 5*a* to 5*c* are vertical cross-section views of a recording head to which dye ink is replenished. FIGS. 6*a* to 6*c* are vertical cross-section views of a recording head to which pigment ink is replenished.

In a case in which dye ink 301*a* is supplied via the ink supply tubes 133 in a direction indicated by an arrow of FIG. 5*a*, the interior of the recording head 134 including nozzles is filled with the dye ink 301*a* (see FIG. 5*a*). When ejection ports 134*a* of the recording head 134 are left open to the ambient air, the solvent of the dye ink vaporizes, thus increasing the concentration of the solution. As a result, the viscosity of dye ink 301*b* near the ejection ports 134*a* in the nozzles increases (see FIG. 5*b*). If the ejection ports 134*a* are further left open to the ambient air, the dye ink 301*b* having an increased viscosity moves toward the rear side of nozzles and the solvent contained in the dye ink vaporizes, thus increasing the concentration of the dye ink (FIG. 5*c*). Thus, an area which the dye ink 301*b* having such an increased viscosity occupies in the nozzles increases with time.

In a case in which pigment ink 302*a* is supplied via the ink supply tubes 136 in a direction indicated by an arrow of FIG. 6*a*, the interior of the recording head 134 including nozzles is filled with the pigment ink 302*a* (see FIG. 6*a*). In ejection ports 134*a* of the recording head 134 are left open to the ambient air, the dispersion medium of the pigment ink vaporizes, thus increasing the concentration of the dispersion liquid. As a result, pigment particles near the ejection ports 134*a* in the nozzles aggregate into solidified portions 302*c* (see FIG. 6*b*). Thus, the solidified portions 302*c* blocks the pigment ink 302*a* from contacting the ambient air, thus minimizing the evaporation of the dispersion medium in the nozzles of the recording head 134. Accordingly, if the ejection ports 134*a* are continuously left open to the ambient air, the solidified portions 302*c* minimizes an increase in the viscosity of the pigment ink. The amount of the solidified portions 302*c* is substantially constant by properties based on the solidification of the pigment ink 302*a*. Accordingly, a predetermined amount of pigment ink (including the solidified portions) determined based on the solidification thereof is suctioned from the nozzles, thus preventing waste of ink.

Next, an example of viscosity properties of ink used in the inkjet recording apparatus according to this exemplary embodiment is described below. It is preferable to use a quick-dry ink having low viscosity-increase rates in a range of moisture evaporation ratio and high viscosity-increase rates that rapidly increase above the range of moisture evaporation ratio. Accordingly, when ink dries and the moisture evaporation ratio goes beyond such a predetermined range, the ink can be solidified for a relatively short time, thus reducing the area of the solidified portions generated in the nozzles.

For example, it is preferable to use a quick-dry ink having viscosity increase rates of 6 (mPa·s/%) or lower in a range of moisture evaporation ratio of 30 wt % or lower and viscosity increase rates of more than 12 (mPa·s/%) in a range of moisture evaporation ratio of more than 30 wt % and not more than 45 wt %. For such a quick-dry ink, when ink is not used, a portion of ink near the ejection ports in the nozzles dries and becomes quickly solidified to form solidified portions. The solidified portions act as covers to prevent ink from drying in the nozzles, thus preventing the evaporation of moisture in the nozzles.

Figure 7:
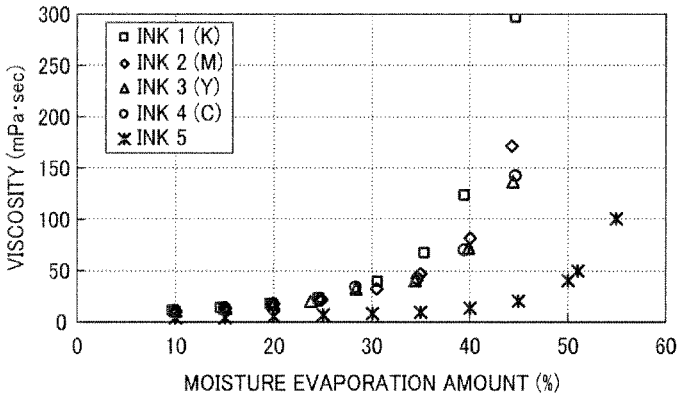
FIG. 7 is a chart showing relationship between moisture evaporation ratio and viscosity of ink.

FIG. 7 is a chart showing the moisture evaporation ratio and viscosity of inks 1 to 5 usable in the inkjet recording apparatus according to this exemplary embodiment.

Inks 1 to 4 are made from known materials (including pigment and water) according to a production method described in JP-2006-016412, and the moisture evaporation ratio and viscosity of the inks 1 to 4 are measured. Ink 5 is are made from known materials (including pigment and water) according to a known production method.

For the ink 1 (black ink), the viscosity increase rate is 5.7 (mPa·s/%) in a range of moisture evaporation ratio from 30 wt % to 35 wt %. The viscosity increase rate of the ink 1 increases with the increase of the moisture evaporation ratio, and is 6.0 (mPa·s/%) or lower in a range of moisture evaporation ratio of 30 wt % or lower. Further, the viscosity increase rate is 33.2 (mPa·s/%) in a range of moisture evaporation ratio from 40 wt % to 45 wt % and 12 (mPa·s/%) or greater in a range of moisture evaporation ratio of greater than 30 wt % and not greater than 45 wt %. Accordingly, the ink 1 is quick-drying and particularly preferably used in the inkjet recording apparatus according to this exemplary embodiment.

For each of the above-described ink 2 (magenta ink), ink 3 (yellow ink), and ink 4 (cyan ink), the viscosity increase rate is from 1.3 (mPa·s/%) to 3.3 (mPa·s/%) in a range of moisture evaporation ratio from 30 wt % to 35 wt %, and 6.0 (mPa·s/%) or lower in a range of moisture evaporation ratio of 30 wt % or lower. Further, the viscosity increase rate is from 14.0 (mPa·s/%) to 21.0 (mPa·s/%) in a range of moisture evaporation ratio from 40 wt % to 45 wt % and 12 (mPa·s/%) in a range of moisture evaporation ratio of greater than 30 wt % and not greater than 45 wt %. Accordingly, the inks 2 to 4 are quick-drying and particularly preferably used in the inkjet recording apparatus according to this exemplary embodiment.

For the ink 5, the viscosity increase rate is 0.34 (mPa·s/%) in a range of moisture evaporation ratio from 30 wt % to 35 wt %, and 6.0 (mPa·s/%) or lower in a range of moisture evaporation ratio of 30 wt % or lower. Further, the viscosity increase rate is 1.16 (mPa·s/%) in a range of moisture evaporation ratio from 40 wt % to 45 wt %, 4.02 (mPa·s/%) in a range of moisture evaporation ratio from 45 wt % to 50 wt %, and not greater than 12 (mPa·s/%) in a range of moisture evaporation ratio of greater than 30 wt % and not greater than 45 wt %. Accordingly, the ink 5 is less quick-drying than the inks 1 to 4.

Figure 9:
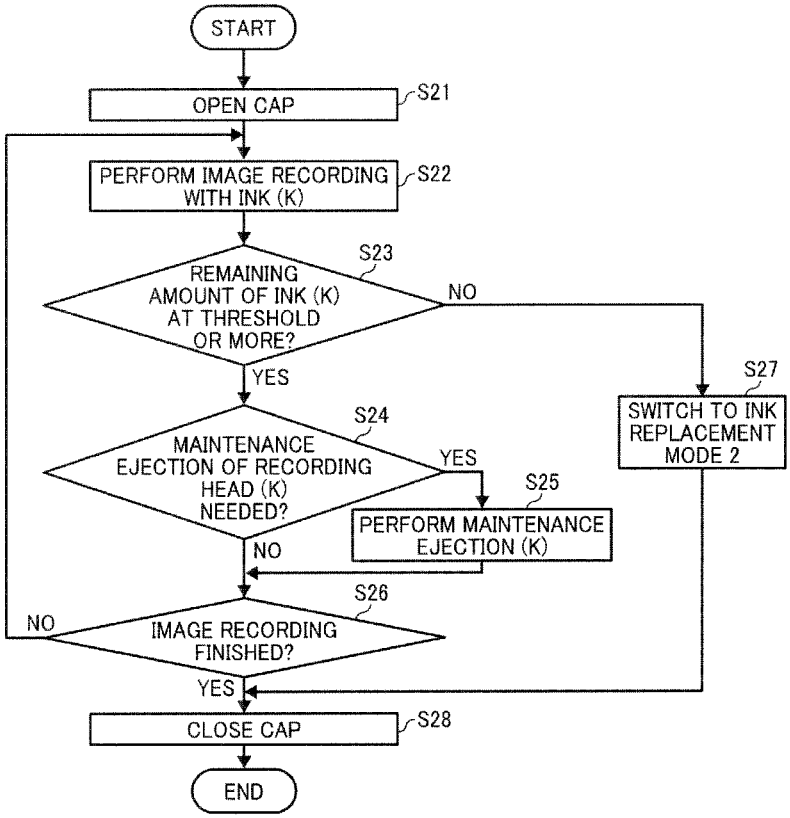
FIG. 9 is a flowchart showing a control procedure of a recording mode using only black ink in the inkjet recording apparatus.
Figure 10:
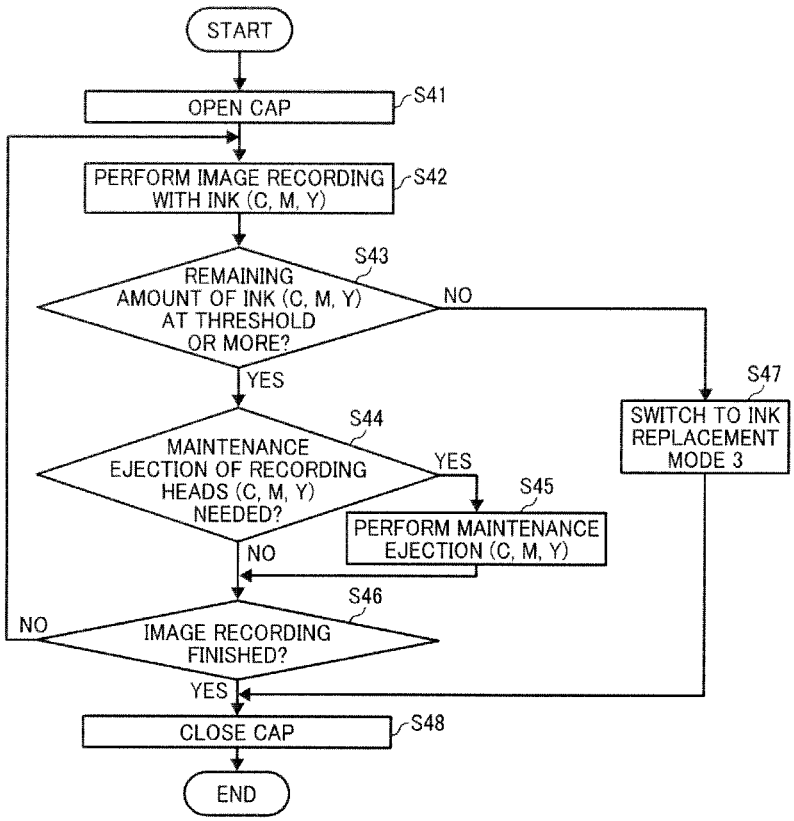
FIG. 10 is a flowchart showing a control procedure of a recording mode using only color inks (other than black ink) in the inkjet recording apparatus.

Next, an example of operation of the inkjet recording apparatus 100 according to this exemplary embodiment is described with reference to FIGS. 8 to 10.

Below, a case in which pigment inks are used as black ink and color inks (meaning inks of colors other than black) is described. However, it is to be noted that a dye ink(s) may be used together if at least one of the black ink and color inks is pigment ink.

Figure 8:
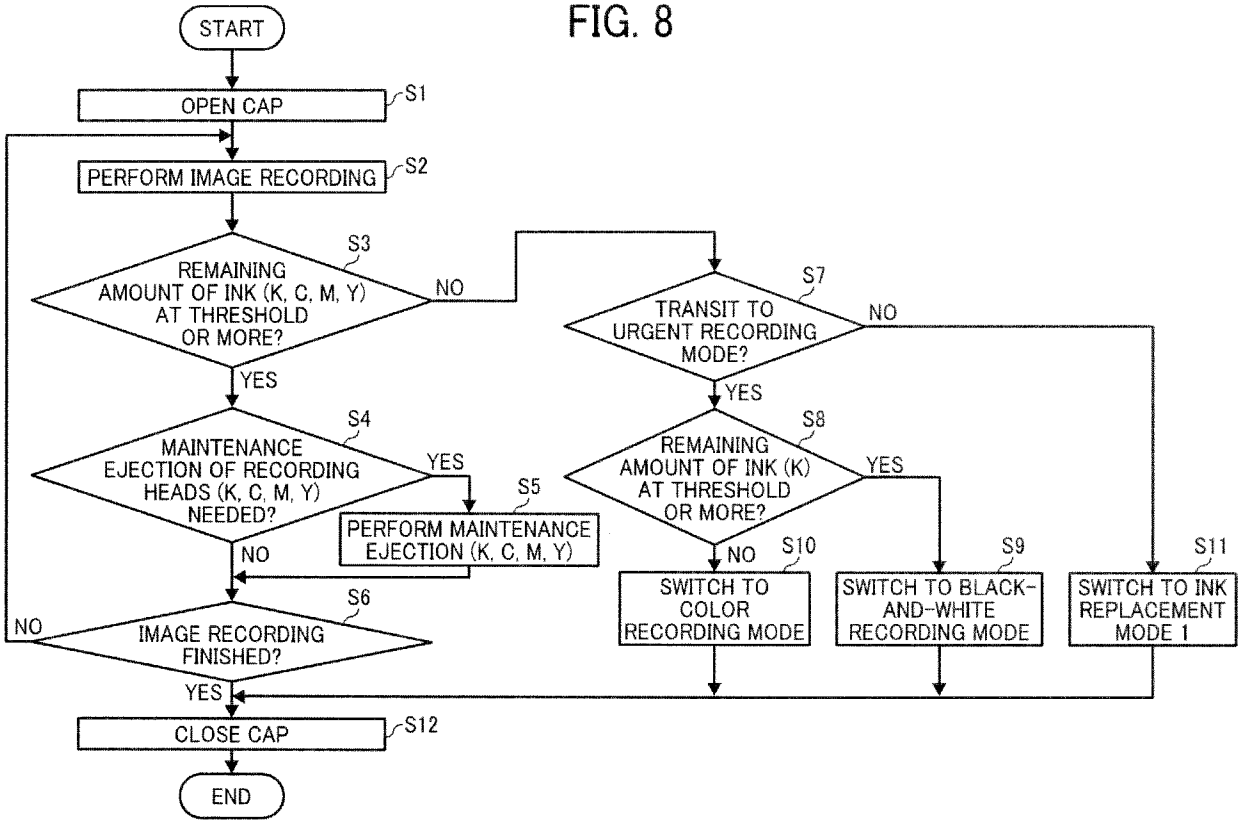
FIG. 8 is a flowchart showing a control procedure of a recording mode using black and color inks in the inkjet recording apparatus.

FIG. 8 is a flowchart showing a control procedure of the inkjet recording apparatus 100 in a recording mode (hereinafter, normal recording mode; an example of second image formation mode) using black ink (as an example of a pigment dispersion liquid or a liquid containing color material) and color inks (as an example of liquids containing color materials or pigment dispersion liquids). FIG. 9 is a flowchart showing a control procedure of the inkjet recording apparatus 100 in a recording mode using only black ink (hereinafter, black-and-white recording mode; as example of first image formation mode). FIG. 10 is a flowchart showing a control procedure of the inkjet recording apparatus 100 in a recording mode using only color inks (hereinafter, color recording mode; as example of first image formation mode). The operations in the control procedures shown in FIGS. 8 to 10 are controlled in accordance with instructions from the device control unit 204 and performed by relevant units and configuration of the inkjet recording apparatus 100.

Below, the control procedure in which the inkjet recording apparatus 100 records an image in the normal recording mode is described with reference to FIG. 8.

When the receiving unit 201 of the inkjet recording apparatus 100 receives image data and a recording instruction, at S1 the caps 182 are opened to start recording. As a result, in each of the recording heads 134 formed with four droplet ejection heads to separately eject ink droplets of yellow, cyan, magenta, and black, ejection ports are opened to the ambient air. At S2 the recording heads 134 eject ink droplets of the respective colors to the sheet 142 in accordance with the image data to record an image on the sheet 142. At S3 the detection unit detects whether or not the remaining amount of each of yellow, cyan, magenta, and black inks is at a predetermined threshold or greater.

If it is determined that the remaining amount of each ink is at a predetermined threshold or greater (YES at S3), at S4 it is determined whether or not ink ejection (maintenance ejection) toward the first droplet receptacle 184 need be performed by the four droplet ejection heads of the recording heads 134. If it is determined that maintenance ejection need be performed (YES at S4), at S5 the droplet ejection heads perform maintenance ejection. After the above-described processing has been completed, at S6 it is determined whether or not image recording has been completed. At this time, the recording control unit 202 determines whether or not there is a job for ongoing recording or subsequent recording. If it is determined that there is no job for ongoing recording nor subsequent recording. If the recording has not been completed (NO at S6), the processing of S2 and subsequent steps is repeated.

If it is determined that the remaining amount of each ink is less than a predetermined threshold (NO at S3), at S7 the operation-and-display unit 105 outputs an indication for selecting whether or not the process should be switched to a recording mode (hereinafter, urgent recording mode) for recording an image without using black ink or color inks, and receives a selection result from an operator of the inkjet recording apparatus 100.

If the received selection result indicates that the process should be switched to the urgent recording mode (YES at S7), at S8 the detection unit determines whether or not the remaining amount of black ink is at a predetermined threshold or greater. If it is determined that the remaining amount of black ink is at a predetermined threshold or greater (YES at S8), at S9 the process is switched from the normal recording mode to the black-and-white recording mode, one type of urgent recording mode, in which an image is recorded in only black ink. If it is determined that the remaining amount of black ink is less than a predetermined threshold (NO at S8), at S10 the process is switched from the normal recording mode to the color recording mode, another type of urgent recording mode, in which an image is recorded in only color inks.

If the received selection result indicates that the process should not be switched to the urgent recording mode (NO at S7), at S11 the process is switched to an operation mode (hereinafter, ink replacement mode 1) for performing ink replacement after the normal recording mode has been performed. In this case, an alert is indicated at, if any, one or more of the remaining-amount indicators 111 corresponding to an ink determined at S3 that the remaining amount of ink is less than the predetermined threshold. Thus, the ink to be replaced is notified to an operator of the inkjet recording apparatus 100.

If it is determined that recording has been completed (YES at S6) or the processing steps of S9, S10, and S11 have been completed, at S12 the caps 182 are closed and the process ends.

Next, a control procedure in which the inkjet recording apparatus 100 records an image in black-and-white recording mode is described with reference to FIG. 9.

In this process, at S21 the caps 182 are opened to start recording. As a result, in each of the recording heads 134 formed with four droplet ejection heads to separately eject ink droplets of yellow, cyan, magenta, and black, ejection ports are opened to the ambient air. At S22 the recording heads 134 eject droplets of black ink to the sheet 142 in accordance with the image data to record an image on the sheet 142. At S23 the detection unit detects whether or not the remaining amount of black ink is at a predetermined threshold or greater. At this step, the remaining amount of black ink is detected again because ejection of black ink at S22 might cause the remaining amount of black ink to be less than the predetermined threshold.

If it is determined that the remaining amount of black ink is at a predetermined threshold or greater (YES at S23), at S24 it is determined whether or not maintenance ejection need be performed by a droplet ejection head for ejecting droplets of black ink in the recording heads 134. If it is determined that maintenance ejection need be performed (YES at S24), at S25 the droplet ejection head for ejecting droplets of black ink performs maintenance ejection. After the above-described processing has been completed, as with S6, it is determined at S26 whether or not the recording has been completed. If the recording has not been completed (NO at S26), the processing of S22 and subsequent steps is repeated.

If it is determined that the remaining amount of black ink is less than a predetermined threshold (NO at S23), at S27 the process is switched to an operation mode (hereinafter, ink replacement mode 2) for performing ink replacement after the black-and-white recording mode has been performed. In this case, an alert is indicated at, if any, one or more of the remaining-amount indicators 111 corresponding to ink determined at S3 and S23 that the remaining amount of ink is less than the predetermined threshold. Thus, the ink to be replaced is notified to an operator of the inkjet recording apparatus 100.

If it is determined that recording has been completed (YES at S26) or the processing of S27 has been completed, at S28 the caps 182 are closed and the process ends. Such recording in the black-and-white recording mode allows the current recording to continue using black ink without being stopped even if the remaining amount of any of color inks is less than the predetermined threshold.

Next, a control procedure in which the inkjet recording apparatus 100 records an image in the color recording mode is described with reference to FIG. 10.

In this process, at S41 the caps 182 are opened to start recording. As a result, in each of the recording heads 134 formed with four droplet ejection heads to separately eject ink droplets of yellow, cyan, magenta, and black, ejection ports are opened to the ambient air. At S42 the recording heads 134 eject ink droplets of yellow, cyan, and magenta to the sheet 142 in accordance with the image data to record an image on the sheet 142. At S43 the detection unit detects whether or not the remaining amount of each of yellow, cyan, and magenta inks is at a predetermined threshold or greater. At this step, the remaining amount of each of yellow, cyan, and magenta inks is detected again because ejection of yellow, cyan, and magenta inks at S42 might cause the remaining amount of yellow, cyan, and magenta inks to be less than the predetermined threshold.

If it is determined that the remaining amount of each of yellow, cyan, and magenta inks is at a predetermined threshold or greater (YES at S43), at S44 it is determined whether or not maintenance ejection need be performed by droplet ejection heads for ejecting droplets of yellow, cyan, and magenta inks in the recording heads 134. If it is determined that maintenance ejection need be performed (YES at S44), at S45 the droplet ejection heads for ejecting droplets of yellow, cyan, and magenta inks perform maintenance ejection. After the above-described processing has been completed, as with S6, it is determined at S46 whether or not the recording has been completed. If the recording has not been completed (NO at S46), the processing of S42 and subsequent steps is repeated.

If the remaining amount of each of yellow, cyan, and magenta inks is less than a predetermined threshold (NO at S43), at S47 the process is switched to an operation mode (hereinafter, ink replacement mode 3) for performing ink replacement after the color recording mode has been performed. In this case, an alert is indicated at, if any, one or more of the remaining-amount indicators 111 corresponding to ink determined at S3 and S43 that the remaining amount of ink is less than the predetermined threshold. Thus, the ink to be replaced is notified to an operator of the inkjet recording apparatus 100.

If it is determined that recording has been completed (YES at S46) or the processing of S47 has been completed, at S48 the caps 182 are closed and the process ends. Such recording in the color recording mode allows the current recording to continue using color inks without being stopped even if the remaining amount of black ink is less than the predetermined threshold.

Figure 12:
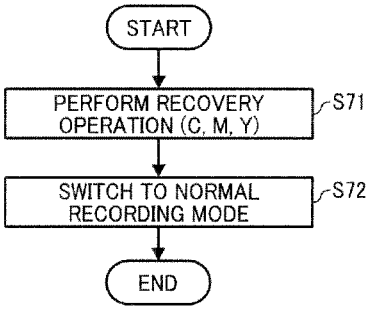
FIG. 12 is a flowchart showing a control procedure of an operation mode for performing ink replacement after black-and-white recording mode.
Figure 13:
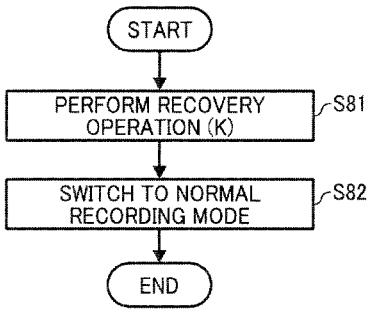
FIG. 13 is a flowchart showing a control procedure of an operation mode for performing ink replacement after color recording mode.

Next, an example of operation of the inkjet recording apparatus 100 according to this exemplary embodiment is described with reference to FIGS. 11 to 13.

Figure 11:
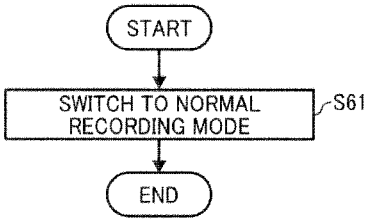
FIG. 11 is a flowchart showing a control procedure of an operation mode for performing ink replacement after normal recording mode.

FIG. 11 is a flowchart showing a control procedure of the inkjet recording apparatus 100 in the operation mode (ink replacement mode 1) for performing ink replacement after the normal recording mode. FIG. 12 is a flowchart showing a control procedure of the inkjet recording apparatus 100 in the operation mode (ink replacement mode 2) for performing ink replacement after the black-and-white recording mode. FIG. 13 is a flowchart showing a control procedure of the inkjet recording apparatus 100 in the operation mode (ink replacement mode 3) for performing ink replacement after the color recording mode. The operations in the control procedures shown in FIGS. 11 to 13 are controlled in accordance with instructions from the device control unit 204 and performed by relevant units and configuration of the inkjet recording apparatus 100.

First, the control procedure in the operation mode (ink replacement mode 1) for performing ink replacement after the normal recording mode is described with reference to FIG. 11.

In the ink replacement mode 1, when it is detected that one or more ink cartridges 110 in which the remaining amount of ink is less than the predetermined threshold have been replaced, at S61 the process is switched from the ink replacement mode 1 to the normal recording mode. In this case, after the ink cartridges 110 is replaced, the maintenance-and-recovery unit 181 does not suction the recording heads 134. This is because image recording is performed in the normal recording mode before the ink replacement. In other words, in the normal recording mode, image recording is performed using yellow, cyan, magenta, and black inks. Accordingly, it is conceivable that little increase in the viscosity of ink occurs in nozzles of any of the four droplet ejection heads for ejecting the separate color inks.

Next, the control procedure in the operation mode (ink replacement mode 2) for performing ink replacement after the black-and-white recording mode is described with reference to FIG. 12.

In the ink replacement mode 2, when it is detected that one or more ink cartridges 110 for color inks in which the remaining amount of color ink is less than the predetermined threshold have been replaced, at S71 the maintenance-and-recovery unit 181 performs recovery operation by suctioning three droplet ejection heads for separately ejecting droplets of yellow, cyan, and magenta inks. This is because image recording is performed in the black-and-white recording mode before the ink replacement. In other words, in the black-and-white recording mode, image recording is performed using black ink with three droplet ejection heads for yellow, cyan, and magenta inks being opened to the ambient air. Accordingly, it is conceivable that the viscosity of ink may be increased in nozzles of the droplet ejection heads for ejecting the color inks. In this case, the amount of color inks to be suctioned is determined based on the solidification property of each color ink. For example, the suction amount of black ink is determined so as to discharge the solidified portions 202*c* (see FIG. 6) from nozzles of the corresponding head. After the recovery operation has been completed, at S72 the process is switched from the ink replacement mode 2 to the normal recording mode, and the process ends.

Next, the control procedure in the operation mode (ink replacement mode 3) for performing ink replacement after the color recording mode is described with reference to FIG. 13.

In the ink replacement mode 3, when it is detected that one or more ink cartridges 110 (including at least the ink cartridge 110*k* for black ink) in which the remaining amount of ink is less than the predetermined threshold have been replaced, at S81 the maintenance-and-recovery unit 181 performs recovery operation by suctioning the droplet ejection head for ejecting droplets of black ink. This is because image recording is performed in the color recording mode before the ink replacement. In other words, in the color recording mode, image recording is performed using yellow, cyan, and magenta inks with the droplet ejection head for black ink being opened to the ambient air. Accordingly, it is conceivable that the viscosity of ink may be increased in nozzles of the droplet ejection head for ejecting black ink. In this case, the amount of black ink to be suctioned is determined based on the solidification property of black ink. For example, the suction amount of black ink is determined so as to discharge the solidified portions 202*c* (see FIG. 6) from nozzles of the corresponding head. After the recovery operation has been completed, at S82 the process is switched from the ink replacement mode 3 to the normal recording mode, and the process ends.

Next, another operation of the inkjet recording apparatus 100 according to this exemplary embodiment is described with reference to FIG. 14.

Figure 14:
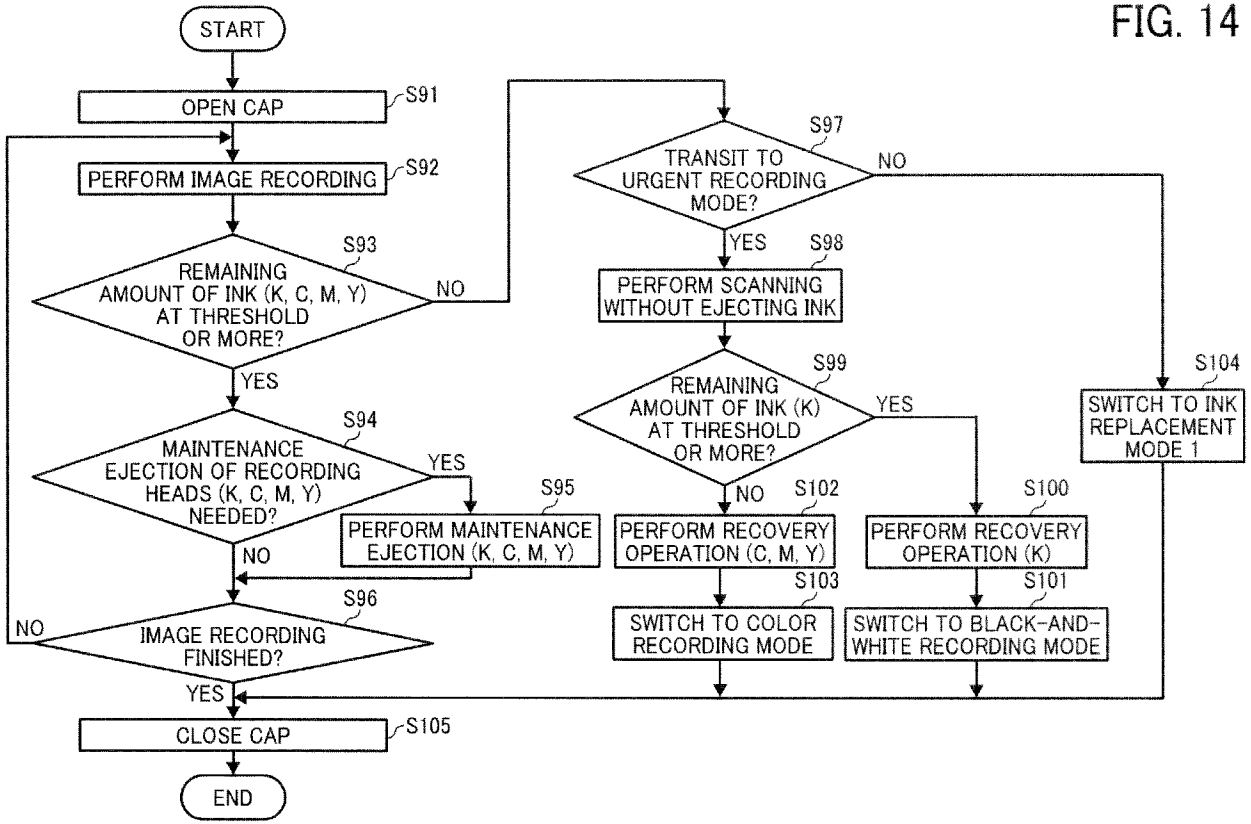
FIG. 14 is a flowchart showing another control procedure of a recording mode using black and color inks in the inkjet recording apparatus.

FIG. 14 is a flowchart showing another control procedure of the inkjet recording apparatus in the normal recording mode. The operations in the control procedure shown in FIG. 14 are controlled in accordance with instructions from the device control unit 204 and performed by relevant units and configuration of the inkjet recording apparatus 100. The operations shown in FIG. 14 can be performed instead of the operations shown in FIG. 8.

When the receiving unit 201 of the inkjet recording apparatus 100 receives image data and a recording instruction, at S91 the caps 182 are opened to start recording. As a result, in each of the recording heads 134 formed with four droplet ejection heads to separately eject ink droplets of yellow, cyan, magenta, and black, ejection ports are opened to the ambient air. At S92 the recording heads 134 eject ink droplets of the respective colors to the sheet 142 in accordance with the image data to record an image on the sheet 142. At S93 the detection unit detects whether or not the remaining amount of each of yellow, cyan, magenta, and black inks is at a predetermined threshold or greater.

If it is determined that the remaining amount of each ink is at a predetermined threshold or greater (YES at S93), at S94 it is determined whether or not ink ejection (maintenance ejection) toward the first droplet receptacle 184 need be performed by the four droplet ejection heads of the recording heads 134. If it is determined that maintenance ejection need be performed (YES at S94), at S95 the droplet ejection heads perform maintenance ejection. After the above-described processing has been completed, as with S6, it is determined at S96 whether or not the recording has been completed. If the recording has not been completed (NO at S96), the processing of S92 and subsequent steps is repeated.

If it is determined that the remaining amount of each ink is less than a predetermined threshold (NO at S93), at S97 the operation-and-display unit 105 outputs an indication for selecting whether or not the process should be switched to a recording mode (hereinafter, urgent recording mode) for recording an image without using black ink or color inks, and receives a selection result from an operator of the inkjet recording apparatus 100.

If the received selection result indicates that the process should be switched to the urgent recording mode (YES at S97), at S98 the carriage 133 is moved back and forth in the main scan direction for a predetermined number of times without ejecting ink from the recording heads 134 to perform non-ejection scanning to solidify ink in the nozzles of the recording heads 134. The number of times for which the carriage 133 moves back and force is preferably, for example, 100 to solidify ink in the nozzles. The non-ejection scanning of the carriage 133 causes ink to dry at ejection ports opened to the ambient air in each of the recording heads 134 to generate the solidified portions of ink. The solidified portions act as covers to prevent ink from drying in the nozzles, thus preventing the evaporation of moisture in the nozzles.

At S99 the detection unit detects whether or not the remaining amount of black ink is at a predetermined threshold or greater. If it is determined that the remaining amount of black ink is at a predetermined threshold or greater (YES at S99), at S100 the maintenance-and-recovery unit 181 performs recovery operation by suctioning the droplet ejection head for ejecting droplets of black ink. Thus, a portion of ink having an increased viscosity in the nozzles can be removed from the droplet ejection head for ejecting droplets of black ink. At S101 the process is switched from the normal recording mode to the black-and-white recording mode for recording an image in only black ink.

If it is determined that the remaining amount of black ink is less than a predetermined threshold (NO at S93), at S102 the maintenance-and-recovery unit 181 performs recovery operation by suctioning the three droplet ejection heads for separately ejecting droplets of yellow, cyan, and magenta inks. Thus, a portion of ink having an increased viscosity in the nozzles can be removed from the droplet ejection heads for ejecting droplets of the color inks. At S103 the process is switched from the normal recording mode to the color recording mode for recording an image in only color inks.

If the received selection result indicates that the process should not be switched to the urgent recording mode (NO at S97), at S104 the process is switched to the operation mode (ink replacement mode 1) for performing ink replacement after the normal recording mode has been performed. In this case, an alert is indicated at, if any, one or more of the remaining-amount indicators 111 corresponding to ink determined at S3 and S93 that the remaining amount of ink is less than the predetermined threshold. Thus, the ink to be replaced is notified to an operator of the inkjet recording apparatus 100.

If it is determined that recording has been completed (YES at S96) or the processing steps of S101, S103, and S104 have been completed, at S105 the caps 182 are closed and the process ends.

As described above, according to this exemplary embodiment, when the process transits to the image formation mode in which a pigment-dispersed liquid is ejected from nozzles onto a recording medium to form an image on the recording medium, the recovery operation is performed by suctioning from the nozzles a predetermined amount of the pigment-dispersed liquid determined based on the solidification properties of the pigment-dispersed liquid. Such recovery operation can completely remove a portion of ink having an increased viscosity from the nozzles.

In addition, in this exemplary embodiment, when the amount of the pigment-dispersed liquid is less than a predetermined amount, the process transits to the first image formation mode in which a liquid containing color material is ejected to a recording medium to form an image on the recording medium without ejecting a pigment-dispersed liquid. Such a configuration can continue image recording without performing ink replacement.

Moreover, when the process transits from the image formation mode in which an image is formed using a pigment-dispersed liquid and a liquid containing color material to the first image formation mode in which a liquid containing color material is ejected to a recording medium to form an image on the recording medium without ejecting a pigment-dispersed liquid, nozzles for ejecting the pigment-dispersed liquid or the liquid containing color material are opened to ambient air for a predetermined period of time. Such a configuration can form the solidified portions at ejection ports of the nozzles, thus preventing the pigment-dispersed liquid from drying in the nozzles.

In addition, the predetermined period of time may be determined based on the solidification of the pigment-dispersed liquid, thus reliably forming the solidified portions at the ejection ports.

Further, when the process transits to the image formation mode in which a liquid containing color material is ejected from nozzles onto a recording medium without ejecting a pigment-dispersed liquid to form an image on the recording medium, the liquid containing color material is suctioned from nozzles. Such a configuration can recover the ejection performance of the recording heads for ejecting the liquid containing color material.

In the above-described exemplary embodiment, if it is determined that the remaining amount of black ink is less than a predetermined threshold (NO at S23), at S27 the process is switched to the ink replacement mode 2 for performing ink replacement after the black-and-white recording mode has been performed. However, it is to be noted that the process may be switched to ink replacement mode 2 under other conditions. In such a case, when the period of time during which the black-and-white recording mode is set on exceeds a threshold, the process may be switched to the ink replacement mode 2. For example, when the period of time during which the black-and-white recording mode is set on exceeds a predetermined period of time (e.g., 5 days), the process may be switched to the ink replacement mode 2. Alternatively, when the period of time during which the ejection ports of the recording heads 134 for the respective inks are opened to the ambient air while the black-and-white recording mode is set on exceeds a predetermined period of time (e.g., one hour), the process may be switched to the ink replacement mode 2. Such a configuration can reduce the increase in viscosity of ink in the nozzles to a certain extent even if moisture vapor pass through the solidified portions of ink formed at the ejection ports to cause drying of ink in the nozzles.

In the above-described exemplary embodiment, if the remaining amount of each of yellow, cyan, and magenta inks is less than a predetermined threshold (NO at S43), at S47 the process is switched to the ink replacement mode 3) for performing ink replacement after the color recording mode has been performed. However, it is to be noted that the process may be switched to ink replacement mode 3 under other conditions. In such a case, when the period of time during which the color recording mode is set on exceeds a predetermined threshold, the process may be switched to the ink replacement mode 3. In such a case, when the period of time during which the color recording mode is set on exceeds a predetermined period of time (e.g., 5 days), the process may be switched to the ink replacement mode 3. Alternatively, when the period of time during which the ejection ports of the recording heads 134 for the respective inks are opened to the ambient air while the color recording mode is set on exceeds a predetermined period of time (e.g., one hour), the process may be switched to the ink replacement mode 3. Such a configuration can reduce the increase in viscosity of ink in the nozzles to a certain extent even if moisture vapor pass through the solidified portions of ink formed at the ejection ports to cause drying of ink in the nozzles.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

an ejection device having a first nozzle and a second nozzle to eject a first liquid and a second liquid, respectively, the first liquid containing pigment particles dispersed in a dispersion medium and the second liquid containing a color material;

a suction device to selectively suction one of the first liquid from the first nozzle and the second liquid from the second nozzle to perform a recovery operation for recovering ejection performance of the ejection device; and a controller to control ejection of the first liquid and the second liquid by the ejection device and suctioning of the first liquid and the second liquid by the suction device, wherein, in a first image formation mode in which the ejection device forms an image on a recording medium by ejecting the second liquid from the second nozzle to the recording medium without ejecting the first liquid from the first nozzle, the controller controls the suction device so as not to suction the first liquid for the recovery operation, and when the first image formation mode is switched to a second image formation mode in which the ejection device forms an image on a recording medium by ejecting at least the first liquid from the first nozzle to the recording medium, the controller controls the suction device so as to suction a predetermined amount of the first liquid determined based on solidification of the first liquid to perform the recovery operation.

2. The image forming apparatus according to claim 1, further comprising:

a liquid container to store the first liquid; and a detection unit to detect an amount of the first liquid in the liquid container;

wherein, when the amount of the first liquid detected by the detection unit is less than a predetermined threshold, a process is switched to the first image formation mode.

3. The image forming apparatus according to claim 1, further comprising a cap unit to cover the first nozzle and the second nozzle, wherein, when the second image formation mode is switched to the first image formation mode, the controller controls the cap unit to not cover the first nozzle and the second nozzle at least for a predetermined period of time to open ejection ports of the first nozzle and the second nozzle to ambient air.

4. The image forming apparatus according to claim 3, wherein the predetermined period of time is determined based on solidification of the first liquid.

5. The image forming apparatus according to claim 3, wherein, when the second image formation mode is switched to the first image formation mode, the controller controls the cap unit to open ejection ports of the first nozzle and the second nozzle to ambient air without covering the first nozzle and the second nozzle at least for a predetermined period of time and controls the suction device to suction the second liquid to perform the recovery operation.

6. A method of forming an image by an image forming apparatus, the apparatus including an ejection device to eject a first liquid and a second liquid from a first nozzle and a second nozzle, respectively, the first liquid containing pigment particles dispersed in a dispersion medium and the second liquid containing a color material, the method comprising:

controlling a suction device of the image forming apparatus so as not to suction the first liquid from the first nozzle for a recovery operation to recover an ejection performance of the ejection device in a first image formation mode to eject the second liquid from the second nozzle without ejecting the first liquid from the first nozzle to form an image on a recording medium, and controlling the suction device so as to suction a predetermined amount of the first liquid determined based on solidification of the first liquid for the recovery operation when the first image formation mode is switched to a second image formation mode to eject at least the first liquid from the first nozzle to form an image on a recording medium.

* * * * *